United States Patent [19]

Palau

[11] Patent Number: 4,716,939

[45] Date of Patent: Jan. 5, 1988

[54] LEVER WITH DOUBLE ROLLERS FOR POSITIVE CAM MECHANISMS FOR CONTROLLING THE HEDDLE FRAMES OF WEAVING LOOMS

[75] Inventor: Joseph Palau, Saint Jorioz, France

[73] Assignee: S.A. des Etablissements Staubli (France), Faverges, France

[21] Appl. No.: 927,073

[22] Filed: Nov. 5, 1986

[30] Foreign Application Priority Data

Dec. 4, 1985 [FR] France ..... 85 18149

[51] Int. Cl.[4] ..... D03C 5/00

[52] U.S. Cl. ..... 139/79; 74/569

[58] Field of Search ..... 139/79, 80, 81; 74/569

[56] References Cited

U.S. PATENT DOCUMENTS

| | | | |
|---|---|---|---|
| 2,654,266 | 10/1953 | Edelen | 74/569 |
| 2,740,853 | 4/1956 | Hartmann | 74/569 |
| 3,800,621 | 4/1974 | Hoglund | 74/569 |
| 3,946,766 | 3/1976 | Amigues | 139/79 |
| 3,986,529 | 10/1976 | Pfarvwaller | 139/79 |

*Primary Examiner*—Henry S. Jaudon

*Attorney, Agent, or Firm*—Dowell & Dowell

[57] ABSTRACT

Levers with double roller assemblies for positive cam mechanisms for controlling the heddle frames of weaving looms wherein each roller assembly comprises a rotating ring supported on a plurality of roller bearings retained relative thereto on a fixed support mounted to or on extension of the levers. The rings and supports are thus capable of penetrating between the cams of the weaving loom without modifying the axial dimensions of an assembly of such cams.

6 Claims, 10 Drawing Figures

LEVER WITH DOUBLE ROLLERS FOR POSITIVE CAM MECHANISMS FOR CONTROLLING THE HEDDLE FRAMES OF WEAVING LOOMS

BACKGROUND OF THE INVENTION

1. Field of the Invention

The present invention concerns cam mechanisms of the positive type which in the textile industry are intended to ensure control of the heddle frames of the weaving looms. More particularly, the invention relates to the levers having double rollers with which the mechanisms of this type are provided.

2. History of the Related Art

In order to clearly set forth the problems associated with the roller assemblies which are currently used with conventional cam mechanisms for controlling the heddle frames of weaving looms, FIGS. 1–3 of the accompanying drawings disclose existing roller assemblies with FIG. 4 showing graphically some of the problems that relate to increasing the spacing between the cam members in order to provide clearance for some types of prior art roller assemblies. FIG. 1 of the accompanying drawings schematically shows the connection between the heddle frame of a weaving loom to one of a series of actuating levers. The number of actuating levers is generally equal to the number of frames. Further, each lever is provided with two follower rollers. The rollers are offset with respect to each other in order to cooperate with two tracks of a complimentry cam.

It should be understood, that if it is desired to give the frames an ample vertical displacement without the need to provide additional mechanical connections between each of the levers associated with each of the corresponding frames, it is necessary that the two conjugate tracks of each cam present profiles widely offset with respect to each other. Consequently, the levers and rollers must penetrate deeply between the two adjacent cams or else the lift of the cams or the stroke of the roller assemblies will be limited and result in increased stress on the roller assemblies thereby creating a shorter life expectancy of the whole mechanism by developing a premature fatigue of the component parts thereof.

Furthermore, it will be noted that the clearance that necessarily established between each of the roller assemblies and cam tracks is passed to the frames and is amplified by an amount equal to the ratio of the stroke of each frame to the stroke of the corresponding roller assemblies. This clearance at the frame is extremely detrimental at high speed as vibrations may be induced which would limit the effective life of the heddles and will thereby reduce the yield of the weaving loom.

SUMMARY OF THE INVENTION

It is essentially an object of the present invention to overcome the foregoing drawbacks by producing a lever having double roller assemblies which make it possible to obtain a very large stroke of the roller assemblies (value c) while making it possible to mount the cams on a draft shaft at a distance with respect to one another which is as small as possible (value e).

In the lever according to the present invention, each of the roller assemblies comprises a rotating ring which cooperates with and is supported by rolling bodies or bearings with the ring and bearings being maintained axially with respect to one another by one or the other of two flanges which are mounted or carried by an extension or support member which is integral with or secured to the lever and which defines a total width substantially equal to that of the rotating ring. In this manner, the ring, roller bearings and the fixed support may penetrate between the cams without interfering with adjacent cams or requiring increased spacing of the cams.

The roller bearings are provided in the form of balls, rollers or needles which constitute an intermediate roller bearing mounted between the support member or fixed extension and the rotating ring. The roller assemblies of the present invention exhibit a very long life with very good yield with respect to the weaving loom as the wear due to the specific pressures and the amount of heat developed on the elements of the roller assemblies is reduced to a considerable extent.

BRIEF DESCRIPTION OF THE DRAWINGS

The invention will be more readily understood upon reading the following description with reference to the accompaning drawings:

FIG. 1 schematically shows a conventional lever with double rollers with cam mechanism of the positive type while

DESCRIPTION OF THE PREFERRED EMBODIMENT

Figure 1:
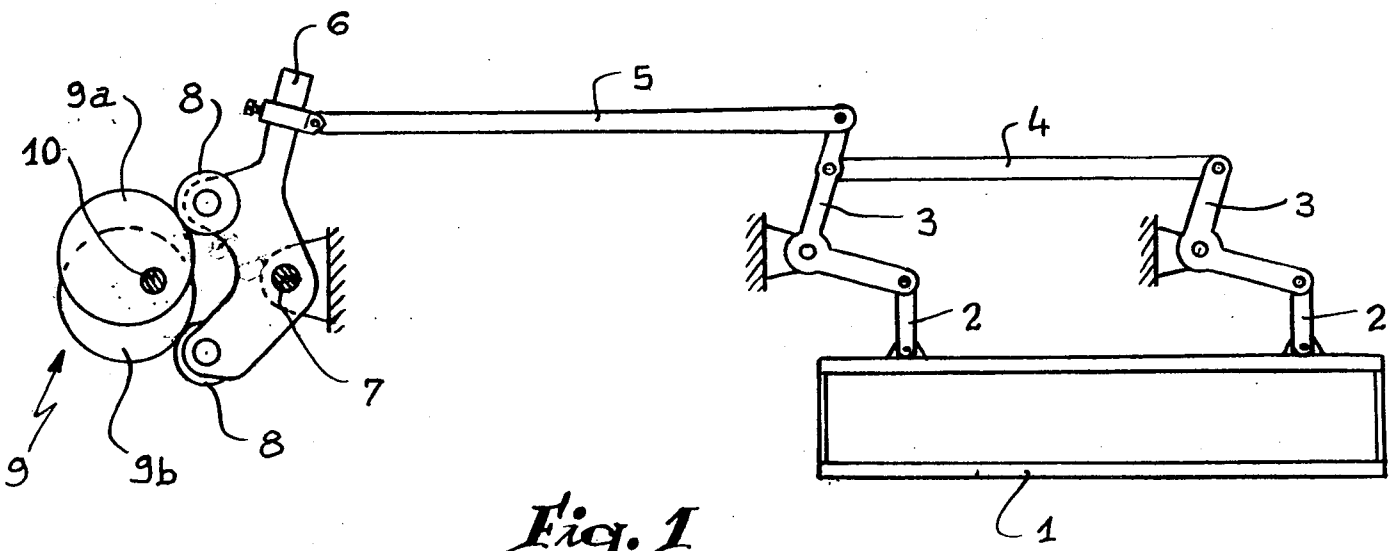
Fig. 1 PRIOR ART

FIG. 1 of the accompanying drawings schematically shows at 1 the type of heddle frame of a weaving loom which is suspended by two small vertical rods 2 from articulated support levers 3 that are coupled together by a horizontal connecting rod 4. One of the levers 3 is connected by a rod 5 to one of a series of actuating levers 6. The number of actuating levers 6 is equal to the number of frames 1. Further, each lever 6 is articulated at a fixed point 7 and provided with two superposed follower rollers 8. The rollers 8 are offset axially with respect to each other in order to cooperate with two conjugate tracks 9*a* and 9*b* of a complimentry cam 9. Each cam 9 is fixed on a shaft 10 which carries all of the cams of the mechanism. The cams are driven in continuous rotation so as to affect a reciprocating vertical displacement of the heddle frames 1 by pivoting the levers 6 about their axis 7.

It should be understood, that if it is desired to give frames 1 an ample vertical displacement without the need to provide additional mechanical connections between each of the levers 6 and the linkages 2, 3, and 4 associated with each of the corresponding frames 1, it is necessary that the two conjugate tracks 9*a* and 9*b* of each complimentry cam 9 present profiles widely offset with respect to each other. Consequently, the levers 6 and rollers 8 must penetrate deeply betwen the two adjacent cams 9 or else the lift of the cams or the stroke of the roller assemblies will be limited and result in increased stress on the roller assemblies thereby creating a shorter life expectancy of the whole mechanism by developing a premature fatigue of the component parts thereof.

Figure 2:
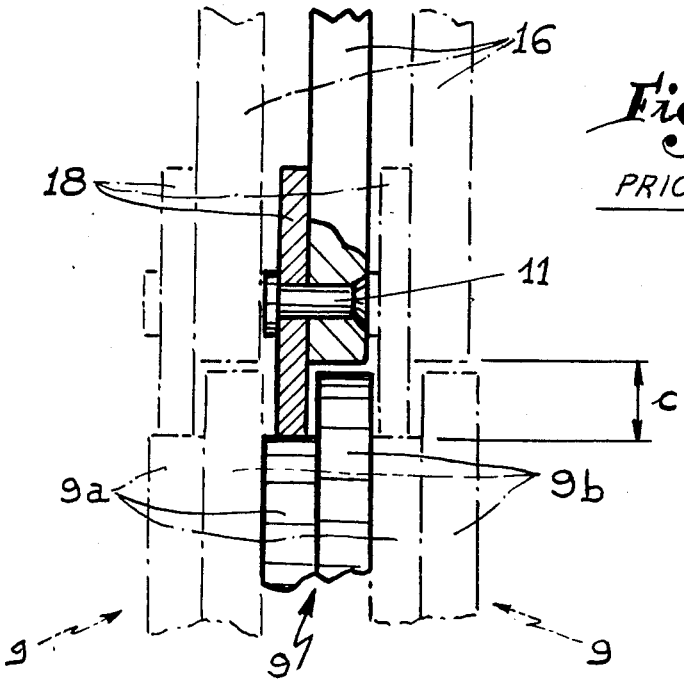
Fig. 2 PRIOR ART
FIGS. 2–4 illustrate three alternative prior art modes of assembly for the roller assemblies of FIG. 1.

In conventional roller assemblies used with such cam mechanisms, the mode of assembly illustrated in FIG. 2 is frequently adopted. Each roller assembly is mounted idly on a pin 11 extending from one of the lateral faces of a lever 16. The pin 11 does not penetrate between the cams 9. These cams are thus capable of being disposed side-by-side on a common shaft so as to be virtually in contact with one another thereby reducing the axial dimensions of the cam assemblies. However, the stroke of the roller assemblies (distance c) is very slight.

Figure 3:
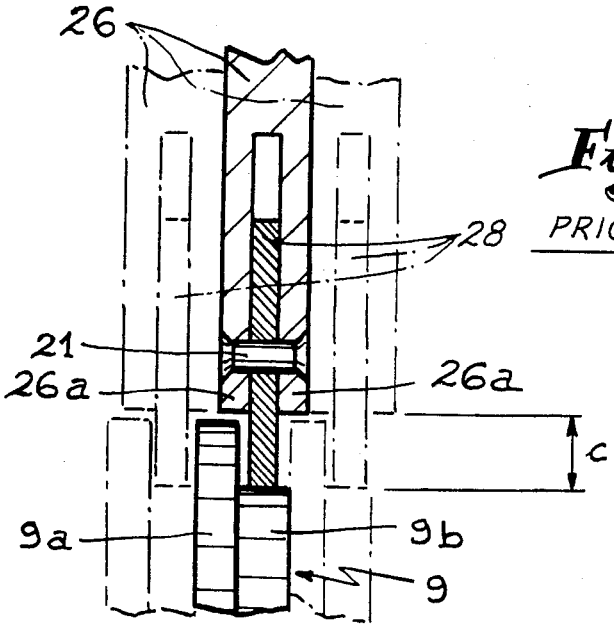
Fig. 3 PRIOR ART

An equivalent result is obtained in an alternative mode of conventional assembly illustrated in FIG. 3. In the alternative assembly, pins 21 carry a rotating ring 28 which acts as the roller for the assembly. The ring is supported by two terminal cheeks or flanges 26*a* of a lever 26. In fact, the stroke c remains limited to the regular lenth of that part of the rotating ring 28 which projects beyond the cheeks 26*a*.

Figure 4:
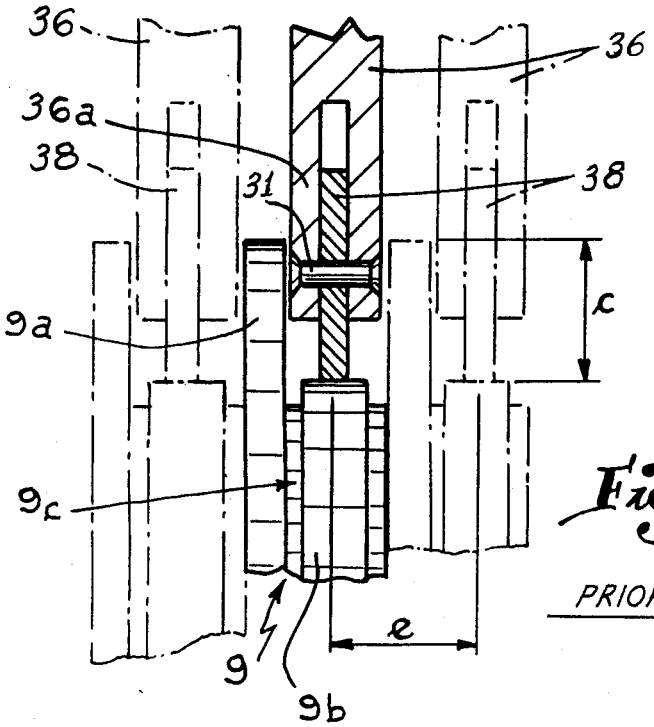
Fig. 4 PRIOR ART
Figure 5:
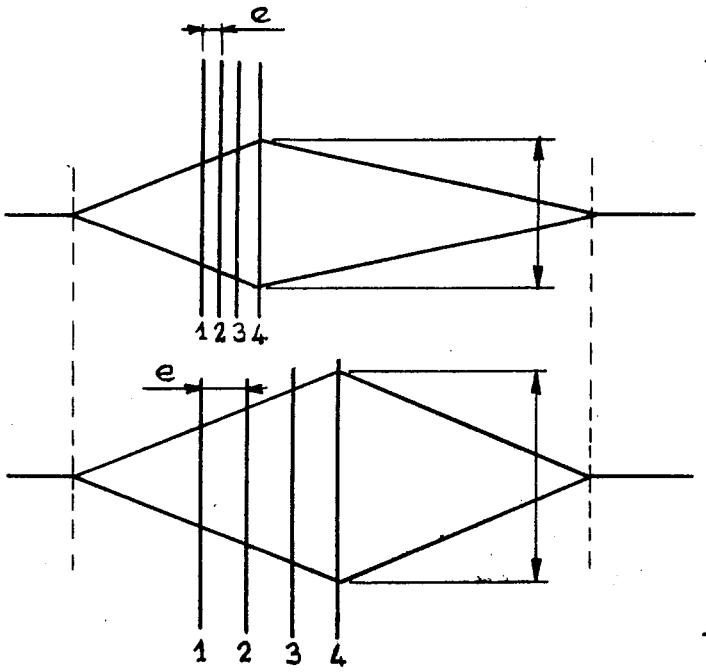
FIG. 5 is a diagram reflecting the increasing in stroke of the heddle frames for increased spacings e of the cams.

In order to avoid this major drawback, it has been proposed, by adopting a mode of assembly according to one of the other FIGS. 2 and 3, to cause a lever carrying the roller assemblies to penetrate between the cams 9 in the manner illustrated in FIG. 4. The limitation of the stroke of the roller assemblies 38 is, of course, thus capable of being as long as desired. However, on the other hand, a considerable drawback is encountered in that it is necessary to increase the spacing between the tracks 9*a* and 9*b* of the cams. This is accomplished, for example, by providing inserts 9*c* or by making wider tracks in order to have sufficient space to allow penetration of the levers 26 or the cheeks 26*a* thereof between the cams 9. Extension of the dimension e increases the bulk or the length of the total packet or number of cams and associated heddle frames 1 of the weaving loom which thereby makes it necessary to increase the stroke of the frames therby placing greater stress on the overall mechanism resulting in a higher tension on the warp yarn. In this manner, the risks of rupture of the yarn are increased with an effective reduction of the yield of the loom. FIG. 5 clearly shows the drawbacks resulting at the level of the heddle frames from the increase of value e at the level of the levers of the small mechanism.

Figure 6:
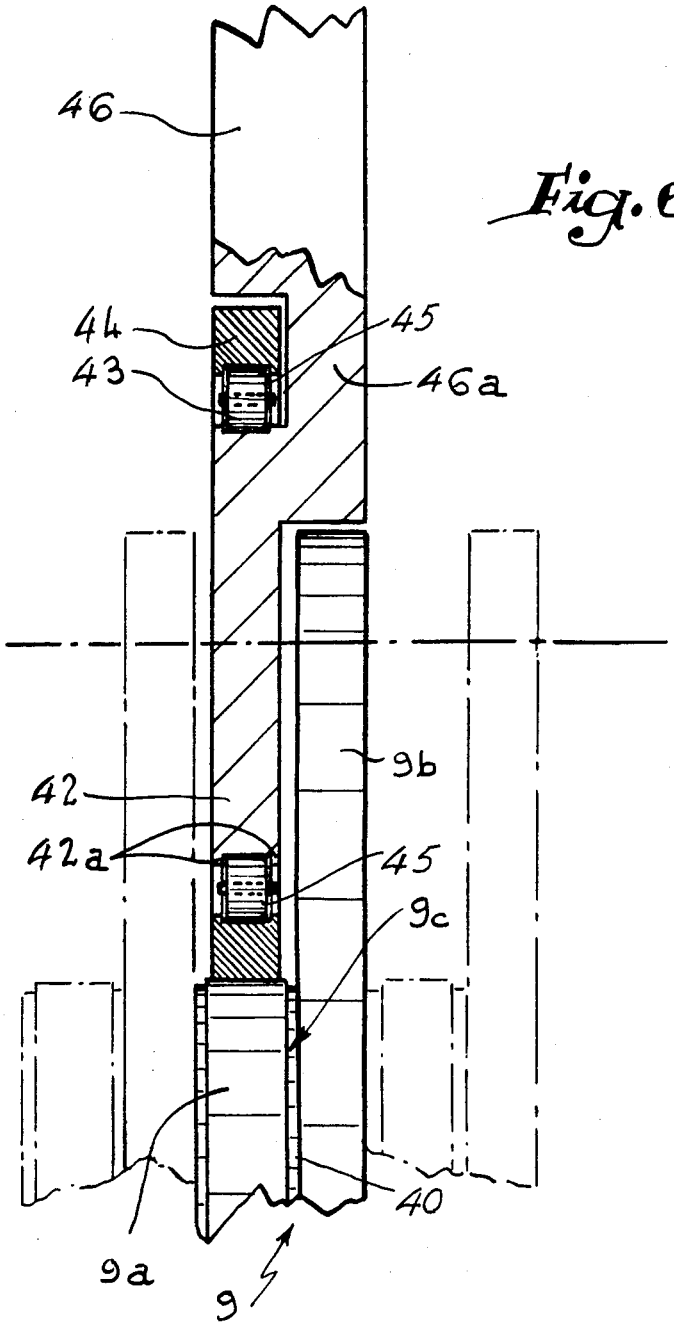
FIG. 6 shows in simplified manner the mode of assembly according to the present invention.
Figure 6A:
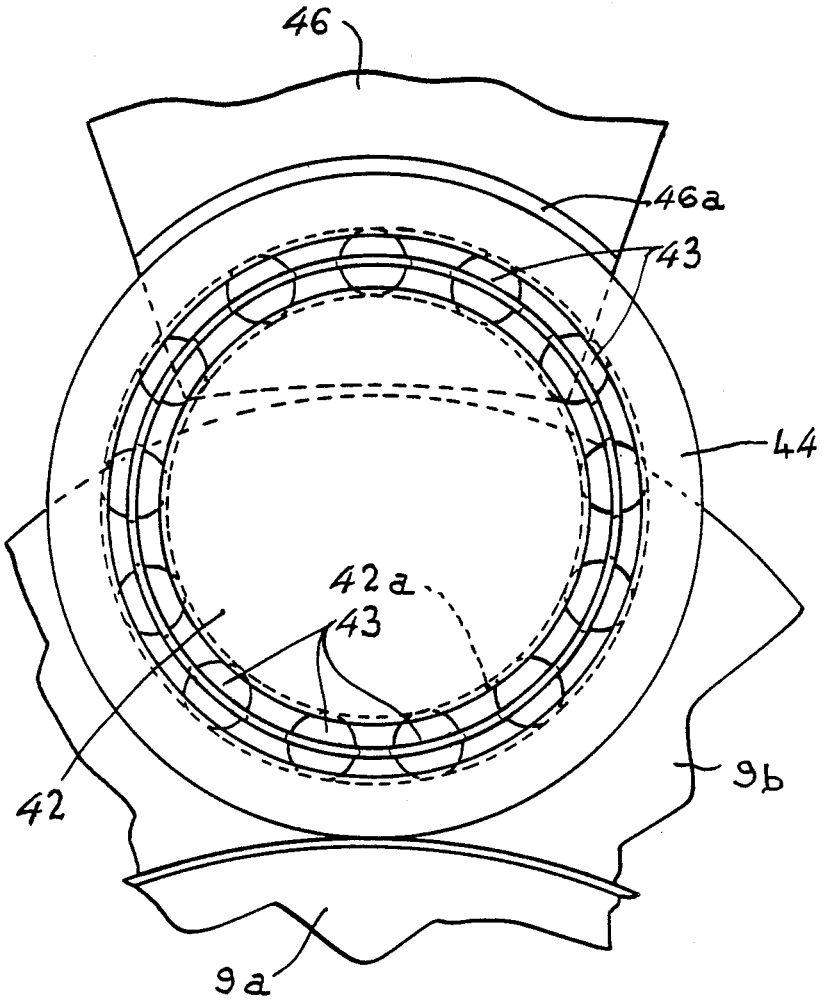
FIG. 6*a* is a view taken from the left of the assembly shown in FIG. 6.

With reference to FIGS. 6 and 6*a*, 4*b* designates the edge of the lever adapted to support one of the two roller assemblies of the present invention in a manner similar to the assembly of FIG. 4. This edge of lever 46 comprises a portion of reduced thickness or a lateral cheek 46*a* which is integrally formed with an eccentric extension adapted to constitute a fixed pin or support 42 for roller bearings 43. The inner edge of a ring 44 is supported on the roller bearings 43. The support 42 and the ring 44 are substantially the same thickness.

Ring 44 is maintained axially by the roller bearings 43 which are retained axially in both directions by two annular flanges 42*a* projecting on the periphy of the fixed pin or support 42. Such position is affected under optimum conditions due to the ring 44 having outer flanges 45. In this manner, any risk of the element shifting with respect to one another or the ring shifting relative to the bearing is avoided.

It will be understood that the fixed ring or excentric support 42 is capable of penetrating or moving between double cams 9 so that the ring 44 may come into contact with the elementary disc 9*a* and 9*b* of the cams thereby allowing a very large stroke and a favorable actuation of the levers 46 to the heddle frame 1 (FIG. 1) with which each of the levers 46 is associated. Such penetration of the rings 44 between the double cams 9*a* and 9*b* in no way modifies the actual dimensions of the assembly of the cams on their common drive shaft 10 as the total thickness of the rings 44 and of the cheeks 46*a* may be at a dimension which is at most equal to the thickness of one of the cams 9*a* and 9*b*.

Tests have shown that such a construction avoids any risk of premature wear of the roller assemblies and their support members and thereby provides an improved general operation of the textile machinery.

Figure 7:
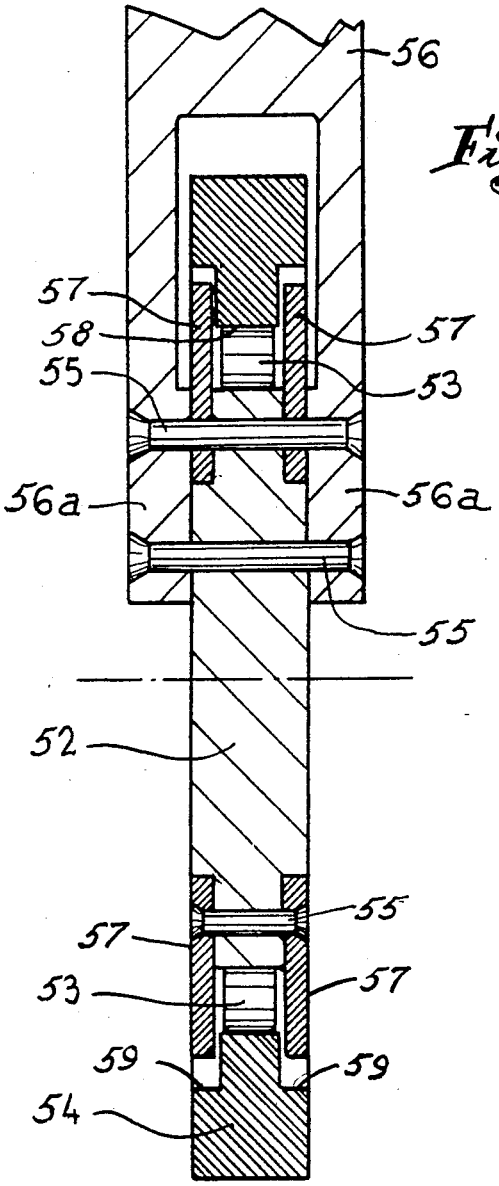
FIG. 7 is a section showing another embodiment of the invention in greater detail.
Figure 7A:
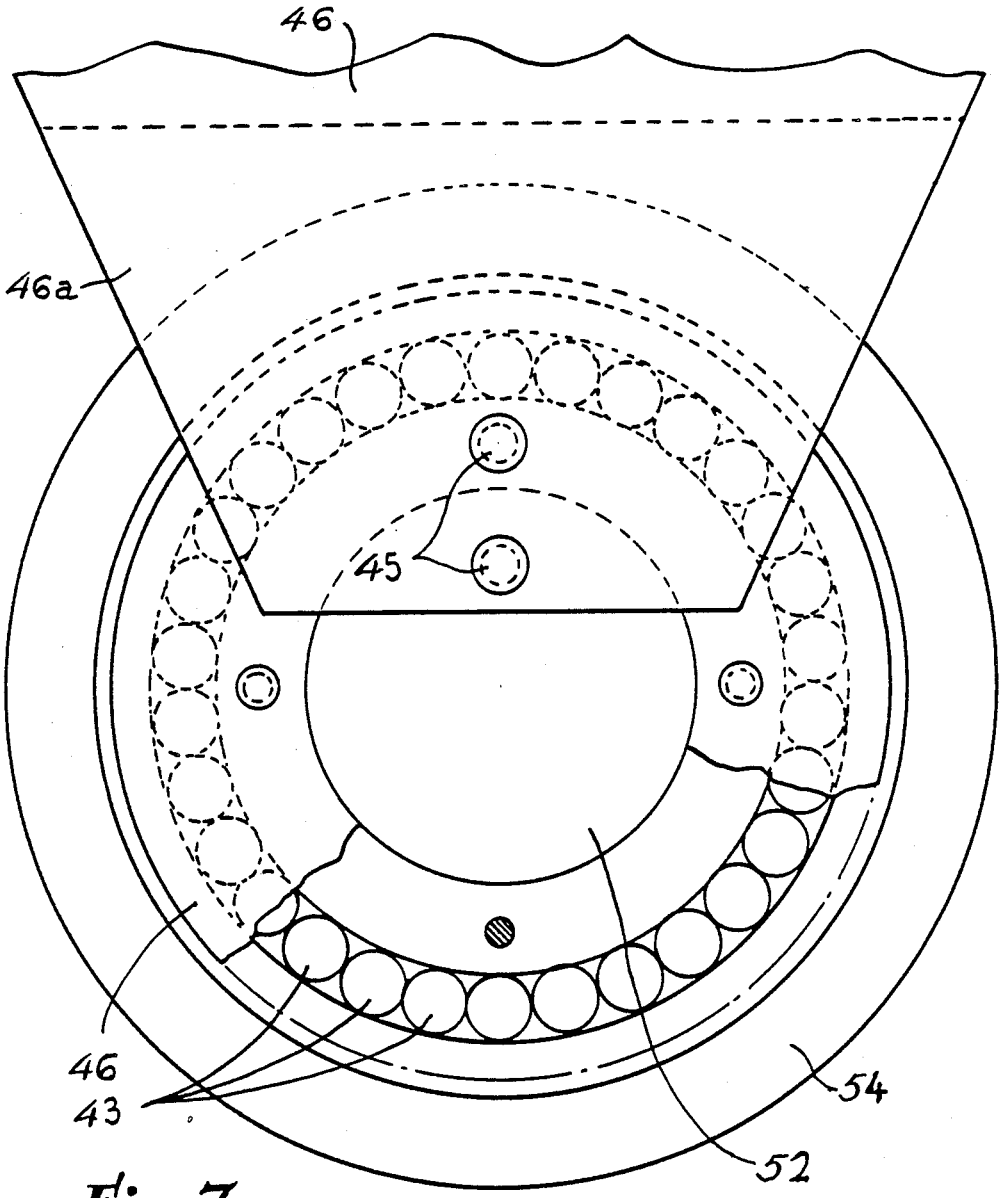
FIG. 7*a* is a side view of the embodiment of FIG. 7 having portions broken away to show the roller bearings.

It will obviously be appreciated that the fixed supports 42 are capable of being mounted in eccentric manner between two terminal cheeks or opposing flanges of a lever similar to the manner shown in FIG. 3. FIGS. 7 and 7*a* illustrate such an embodiment and it may be seen that the support 52 of the lever 56 is fixed for instance utilizing rivets such as shown at 55 between two reduced cheek or flanged portions 56*a* of the lever 56. Such a mounting is also accomplished in an eccentric manner. Roller bearings 53 are interposed between the structures 52 and the rotating rings 55 and are retained axially in both directions by a pair of annular flanges or stops 57 which are secured to the support members 52 and extend outwardly therefrom. In this embodiment, each ring 54 includes an inner surface having a centrally raised portion 58 and a pair of outer shoulder portions 59.

Figure 8:
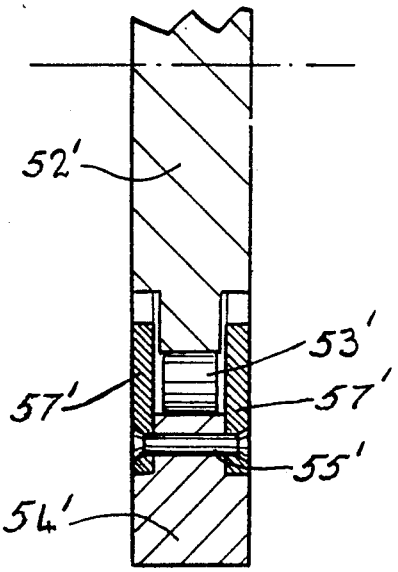
FIG. 8 illustrates a variation of the assembly of FIG. 7.

A variation of the embodiment of the invention shown in FIG. 7 is shown in FIG. 8. In this embodiment, the flanges or the retaining stops 57' are fixed laterally or attached to the ring 54' as opposed to being attached to the support member 52'.

It must, moreover, be understood that the foregoing description has been given only by way of example and in no way limits the domain of the invention which would not be exceeded by replacing the details of execution described by any other equivalents.

What is claimed is:

1. In a lever assembly for interacting the cam mechanisms used for controlling the movement of a heddle frame of a weaving loom with the heddle frame wherein the lever assemblies include two spaced roller assemblies which follow the tracks created by two axial offset cam members revolving about a common rotating shaft, the improvement comprising each of said roller assemblies including a rotating ring having inner and outer surfaces and a width dimension, said inner surface of said ring being moveably supported on a plurality of roller bearing means, means for retaining said roller bearing means in general alignment with said ring, extension means carried by the lever assemblies for supporting said rings in contact with the cam members, and said extension means, said roller bearing means and said means for retaining said roller bearing means having a combined width dimension which does not exceed said width dimension of said rings.

2. The lever assembly of claim 1 in which said means for retaining said roller bearing means includes a first pair of spaced flange elements mounted to said entension means so as to be spaced on opposite sides of said roller bearing means.

3. The lever assembly of claim 2 in which said means for retaining said roller bearing means includes a second pair of spaced flange elements disposed on and extending from said inner surface of said rotating ring, said second pair of spaced flange elements extending on opposite sides of said roller bearing means in opposing relationship to said first pair of spaced flange elements.

4. The lever assembly of claim 3 is which said extension means is integrally formed with the lever assembly.

5. The lever assembly of claim 2 in which the lever assembly includes a pair of spaced flanges, means for mounting said extension means between said spaced flanges whereby said rotating rings is rotatable likewise said spaced flanges.

6. The lever assembly of claim 1 in which said means for retaining said roller bearing menas includes a pair of spaced flange elements secured to said rotating ring and extending on opposite sides of said roller bearing means.

* * * * *